US005260752A

United States Patent [19]

Fuma et al.

[11] Patent Number: 5,260,752

[45] Date of Patent: Nov. 9, 1993

[54] IMAGE FORMING METHOD INCLUDING AN ADDITIONAL EXPOSING STEP

[75] Inventors: Hiroshi Fuma; Hisahiro Saito; Mikihiko Takada, all of Hachioji, Japan

[73] Assignee: Konica Corporation, Tokyo, Japan

[21] Appl. No.: 888,975

[22] Filed: May 26, 1992

[30] Foreign Application Priority Data

May 30, 1991 [JP] Japan ..... 3-127518

[51] Int. Cl.[5] ..... G03G 15/14

[52] U.S. Cl. ..... 355/273; 355/271; 355/326 R; 430/42; 430/48

[58] Field of Search ..... 355/326, 327, 328, 210, 355/219, 245, 271, 273, 77; 346/153.1, 160; 430/32, 42, 44, 48, 100

[56] References Cited

U.S. PATENT DOCUMENTS

| | | | |
|---|---|---|---|
| 4,443,095 | 4/1984 | Tsushima et al. | 355/326 |
| 4,515,462 | 5/1985 | Yoneda | 355/326 |
| 4,557,992 | 10/1985 | Haneda et al. | 430/122 |
| 4,599,285 | 7/1986 | Haneda et al. | 430/54 |
| 4,839,692 | 6/1989 | Shoji et al. | 355/327 X |
| 4,853,736 | 8/1989 | Goto et al. | 355/210 |
| 5,089,847 | 2/1992 | Folkins | 355/328 X |
| 5,126,795 | 6/1992 | Maruyama et al. | 355/245 X |

FOREIGN PATENT DOCUMENTS

| | | |
|---|---|---|
| 0263501 | 4/1988 | European Pat. Off. . |
| 3524159 | 1/1986 | Fed. Rep. of Germany . |
| 59-181362 | 10/1984 | Japan . |
| 60-76766 | 5/1985 | Japan . |
| 62-52565 | 3/1987 | Japan . |

OTHER PUBLICATIONS

Patent Abstracts of Japan vol. 12, No. 313 (P-749) Aug. 25, 1988 & JP-A-63 081 378 (Ricoh Co.) Apr. 12, 1988 *abstract*.

*Primary Examiner*—A. T. Grimley
*Assistant Examiner*—Sandra L. Brase
*Attorney, Agent, or Firm*—Frishauf, Holtz, Goodman & Woodward

[57] ABSTRACT

An image forming method in which toner images are registered onto an image retainer by conducting sequentially a cycle of charging, imagewise exposing and developing by the method of reversal development not less than twice. The imagewise exposing, based on all image data which have formed latent images is performed again only on the toner image portion after all the developing steps have been completed, then the toner images are transferred onto a transfer sheet at one time.

16 Claims, 4 Drawing Sheets

IMAGE FORMING METHOD INCLUDING AN ADDITIONAL EXPOSING STEP

BACKGROUND OF THE INVENTION

The present invention relates to an image forming method in which an electrostatic latent image is formed on an image retainer of an electrostatic recording apparatus such as an electrophotographic copying apparatus, the formed electrostatic latent image is developed into a visualized image (toner image), and the visualized image is transferred onto a transfer sheet.

In an image forming apparatus in which an electrophotographic method or an electrostatic recording method is used, an electrostatic latent image is formed on an image retainer and the image is developed by toner which is a charged particle. The above-described principles are used in order to obtain a color image or a composite image (a plurality of originals or an image information and an original image are superimposed) in the following manner. That is, the image is obtained when a series of operations of charging, exposing and developing are repeatedly conducted not less than twice on an image retainer composed of a conductive base plate having a photoconductive layer thereon (for example, refer to U.S. Pat. No. 4,599,285).

The image forming method can develop a color image or perform composite images, and the superimposed toner images can be transferred onto a transfer sheet by a single transfer process, so that the apparatus, in which a color image or a composite image can be obtained, can be structured simply.

As a developing method by which the above-described image forming process can be accomplished, it is required to develop the image under the conditions disclosed, for example, in U.S. Pat. No. 4,557,992 or Japanese Patent Publication Open to Public Inspection No. 52565/1987 by using developing agent composed of non-magnetic toner and magnetic carrier. In a developing unit, developing agent is conveyed in the following manner: the developing agent is stirred to charge the toner, for example, negatively; the charged toner is adhered onto a magnetic carrier surface by electrostatic force, as described above; the developing agent, in which toner is combined with carrier electrostatically, is magnetically attracted onto the surface of a developing sleeve and is kept on the surface; and the developing agent is conveyed to a developing area while the developing sleeve is rotated at a predetermined line speed. The developing method is one of magnetic brush developing methods, and it is characterized in that: the magnetic brush is not contacted with the image retainer; and only toner is attracted to a latent image on the image retainer by a D.C. bias voltage or superimposing an A.C. bias voltage onto a D.C. bias voltage.

As an example of an image forming apparatus to which the image forming process and developing method, as described above, are applied, there exists an color image forming apparatus in which a latent image is formed at each color by a latent image forming method, and the image is developed by a developing unit containing color toner corresponding to each latent image.

In this kind of an image forming apparatus, the apparatus in which a ray of laser light or the like is irradiated on an image retainer (hereinafter, called a photoreceptor) having photoconductive material on a conductive base plate in order to form a latent image, is a typical one. Further, there is a method in which a tip of an LED is turned ON/OFF by a shutter such as a liquid crystal instead of a laser.

In such an image forming apparatus, a color toner image is formed in the toner image forming process shown in FIGS. 3(*a*) to 3(*f*).

FIGS. 3(*a*) to 3(*f*) are illustrations showing a toner image forming process in which toner images are superimposed on the photoreceptor after repeating charging, image exposing and developing.

As shown in FIG. 3(*a*), the photoreceptor is uniformly charged by the method of corona discharging by a charger, and the surface potential of the photoreceptor becomes uniform surface potential VH.

A laser exposing unit irradiates a laser beam so that the latent image can be formed on the surface of the photoreceptor. At this time, the surface potential of the photoreceptor on which a latent image is formed, is lowered from surface potential VH to VL1 as shown in FIG. 3(*b*). Surface potential VL1 of the photoreceptor is the surface potential of the electrostatic latent image formed at the first step, and is called exposure potential VL1. The surface potential of the electrostatic latent image formed on the surface of the photoreceptor is determined by an amount of laser light. Due to the aforementioned, development potential gap VG1 is generated between surface potential VDC of the developing sleeve due to a D.C. component of the bias voltage applied from a development bias circuit of the developing unit and exposure potential VL1. This development potential gap VG1 contributes to the following development in the following manner: electric field due to this developing gap VG1 goes from the surface of the latent image on the surface of the photoreceptor to the surface of the developing sleeve, and therefore toner, which is a negatively charged particle, is attracted by electric force going to a portion of the latent image on the surface of the photoreceptor. However, the electric force is not large enough to separate the toner including electrostatically combined charged particles, from the magnetic carrier. On the other hand, the developing agent which is kept on the surface of the developing sleeve by magnetic force, is subjected to further force when an A.C. component of bias voltage applied from the development bias circuit has the same polarity as a D.C. component, so that the toner flies towards an exposure portion with an exposure potential $V_{L1}$ of the photoreceptor from the developing sleeve and adheres to the electrostatic latent image by electrostatic force. In this way, as shown in FIG. 3(*c*), the latent image on the photoreceptor is developed into the first toner image in the following manner that the toner including negatively charged particles is electrostatically adhered to the electrostatic latent image and developed. At this time, surface potential of the first toner layer adhered to the electrostatic latent image on the surface of the photoreceptor is equal to toner layer surface potential VT1.

The surface of the photoreceptor on which a toner layer is formed in the aforementioned first development process, is uniformly re-charged by the method of scorotron discharge with the charger, so that the surface potential of the photoreceptor becomes surface potential VH and the photoreceptor is ready for the next latent image formation. At this time, in the potential distribution of the surface of the photoreceptor as shown in FIG. 3(*d*), the surface is almost uniformly charged, and surface potential of the photoreceptor is VH.

The second image exposure is conducted by the laser exposing unit and the second latent image is formed on the photoreceptor surface. FIG. 3(*e*) shows the potential distribution of the photoreceptor surface at this time as follows. The surface potential of the photoreceptor at the first image exposure is lowered from VH to exposure potential VL1 as described above, the surface potential of the photoreceptor at the second image exposure is lowered from VH to re-exposure potential VL2, and the toner layer surface potential which is formed on the photoreceptor surface is lowered from the vicinity of VT2 to VT2. At this point, development potential gap VG1 which is the potential difference between surface potential VDC of the developing sleeve and exposure potential VL2 is generated, and development potential gap VG2 which is the potential difference between surface potential VDC of the developing sleeve and the re-exposure potential VL2 is generated. These development potential gaps VG1 and VG2 contribute to the next development. However, as described above, only the electric field due to these development potential gaps VG1 and VG2 does not generate enough electric force to separate the toner including electrostatically combined charged particles, from the magnetic carrier. At this point, also, when an A.C. component of the bias voltage applied from the development bias circuit, becomes the same polarity as the potential gaps due to VG1 and VG2, the force to convey the toner to the photoreceptor becomes large, so that the toner flies to the photoreceptor and adheres thereto. Due to the aforementioned, the latent image on the surface of the photoreceptor attracts the negatively charged toner electrostatically as shown in FIG. 3(*f*), so that the second toner layer is obtained by development.

After this process, a color toner image or a composite toner image is obtained on the photoreceptor by repeating the same process as the aforementioned by a required number of times. The toner image is transferred at one time onto a transfer sheet after the back of the transfer sheet has been charged to a reverse polarity to the toner by the transfer unit, and further the transfer sheet is heated or pressed for fixing, so that the composite image or color image can be obtained.

The aforementioned transfer of the toner image onto the transfer sheet is affected by the following conditions. When humidity becomes high, in the case of a transfer sheet which is difficult to obtain the uniform insulation property, its insulation property is lowered partially; and transition of electric charge is generated, so that the transferred charge is lost. As a result, transfer efficiency is partially lowered, and exceedingly uneven transfer, with the toner layer partially stripped off, is caused. In order to prevent the uneven transfer, a pre-transfer exposure method by which the entire surface is uniformly exposed just before transfer after all developments have been completed, is disclosed. When the pretransfer exposure is conducted, it is experimentally confirmed that the aforementioned uneven transfer can be prevented. However, toner particles themselves are charged in the manner of the same polarity as shown in FIG. 4, and therefore some toners are spattered around the edge portion of the toner image by an electrical repulsive force, the image becomes dirty, and resolution of the image is lowered, which are problems. This comes from the following reasons. The toner image is formed in an electric potential well at the development as shown in FIGS. 3(*c*) and 3(*f*), and therefore the electrical repulsive force caused by electric charges of toner still remains. When electric charge around the toner image is neutralized, the toner image portion has a protruded potential in contrast with the aforementioned, a portion of the toner is splashed around the toner image, and therefore the electrical repulsive force of the toner itself is released. Accordingly, the pre-transfer exposure method by which the entire surface of the toner image is uniformly exposed before transfer, does not become a perfect solution to the problem.

From the aforementioned reason, in order to prevent inferior transfer at the time of high humidity, it is required to provide a heater in the apparatus in order to prevent humidity rise of a transfer sheet and a transfer belt. Therefore there are problems in which the apparatus becomes complicated, or a specially treated precious transfer material should be used so that the transfer material is not affected by humidity.

SUMMARY OF THE INVENTION

The object of the present invention is to solve the above-described problems and to provide an image forming method by which inferior transfer is not caused at the time of high humidity, without complicating the apparatus.

The object of the present invention is accomplished by an image forming method in which a toner image is superimposed onto an image retainer by conducting sequentially a cycle of charging, image exposing and developing not less than twice, and then transferring the toner images onto a transfer sheet at one time, and which is characterized in that only the toner image portion (a portion to which toner adheres on the photoreceptor) is exposed just before transfer after developing has been completed. Further, in the image forming method, the aforementioned developing is conducted by the method of reversal development. It is a matter of course that the aforementioned sentence 'after developing has been all completed' does not means 'after toner image formation has been entirely completed', but the aforementioned sentence means that the toner image portion is exposed successively from the portion on which development of the final toner image formation cycle has been conducted.

DETAILED DESCRIPTION OF THE PREFERRED EMBODIMENT

Figure 1:
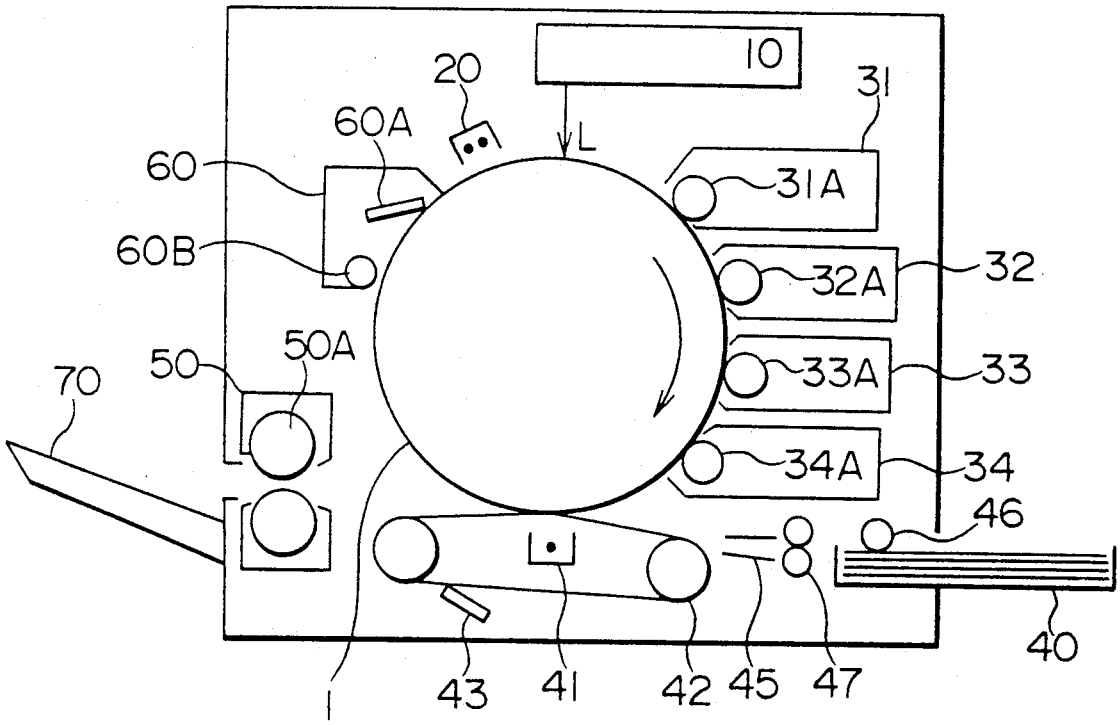
FIG. 1 is a view showing the outline of structure of an example of a color image forming apparatus to which the present invention is applied.

FIG. 1 is a drawing showing an outline of structure of an embodiment of a color image forming apparatus to which an image forming method of the present invention is applied.

In FIG. 1, the numeral 1 is a photoreceptor drum, which is an image retainer, provided with a photoreceptor layer consisting of, for example, an organic photoconductor (OPC) on the circumferential surface of a base body composed of a drum-shaped conductor which is rotated at a predetermined peripheral speed in an arrowed direction, the numeral 20 is a scorotron type charging electrode which is a charging means, and the numeral 10 is a laser exposing unit which conducts image exposing (writing) by using laser beam L, which is an exposure beam, at the exposed portion between the charger 10 and a developing unit. The numerals 31 to 34 are developing units which are a plurality of developing means containing developing agents consisting of different colored toners. These image forming means are provided around the photoreceptor drum 1. Developing units 31, 32, 33, and 34 contain developing agents of yellow, magenta, cyan, black, for example, and the developing units are provided with developing sleeves 31A, 32A, 33A, 34A which are separated from the photoreceptor with predetermined gaps, and have the function by which a latent image on the photoreceptor is visualized by the method of a non-contact reversal development. Differing from the contact development method, the non-contact developing method has an advantage in that the toner image is not disturbed even when the toner image exists on the photoreceptor.

The numeral 40 is a paper feed cassette, the numeral 41 is a transfer electrode, the numeral 42 is a transfer belt, and the numeral 43 is a transfer belt cleaning blade. The transfer belt 42 is held under the condition that it is usually separated from the photoreceptor drum 1, and it comes into contact with the photoreceptor only when the operation is conducted on the transfer process. The numeral 50 is a fixing unit, and the numeral 60 is a cleaning unit. A blade 60A of the cleaning unit 60 is held at the separated position from the surface of the photoreceptor drum 1 during formation of the image, and it comes into contact with the surface of the photoreceptor with pressure as shown in the drawing only when cleaning is conducted after image transfer. A guide roller 60B is held under the separated condition from the photoreceptor drum 1.

The color image forming process of the above-described color image forming apparatus is conducted as follows.

When each color image data outputted from an image reading apparatus or an image information generating apparatus is inputted into the laser exposure unit 10, laser beam L generated from a laser diode, which is a light source for writing and not shown in the drawing, passes through a collimator lens, which is not shown in the drawing, in the laser exposure unit 10. Then, laser beam L is rotatively scanned by a polygonal mirror, and passes through $f\theta$ lens and cylindrical lens and the like, and its optical path is bent by mirrors when necessary during the above-described passage. After that, laser beam L is projected on the image area of the circumferential surface of the photoreceptor drum 1 which has been uniformly charged in advance, and the primary scanning for exposure is conducted according to the image information.

Laser beam L which is modulated by the first color image data scans on the circumferential surface of the photoreceptor drum 1. Accordingly, the latent image corresponding to the first color is formed on the circumferential surface of the photoreceptor drum 1 by the primary scanning with laser beam L and the subsidiary scanning by rotation of the photoreceptor drum 1. The latent image is developed by the developing unit 31 which is one of the developing means and is loaded by a yellow toner, so that the yellow toner image is formed on the circumferential surface of the photoreceptor drum 1. The obtained toner image passes under the cleaning unit 60, which is a cleaning means and is separated from the circumferential surface of the photoreceptor drum 1, while being held on the circumferential surface of the photoreceptor drum, and enters the following image forming cycle.

The image area of the photoreceptor drum 1 is charged again by the charger 20. Then, the second color image data outputted from an image data processing section is inputted into the laser exposing unit 10, and image exposing is conducted onto the same image area as the circumferential surface of the photoreceptor drum 1 in the same manner as that of the first color, so that the latent image is formed. The latent image is developed by the developing unit 32 which is loaded with magenta toner as the second color.

The magenta toner image is formed on the same image area as the yellow toner image which has been formed already.

The numeral 33 is the developing unit loaded with cyan toner. The third color image data generated from the image data processing section is inputted into the laser exposing unit 10, image exposing is conducted so that the latent image may be formed, and the latent image is developed by the developing unit 33 which is loaded with cyan toner as the third color, in the same manner as that of the preceding color, and the cyan toner image is formed on the drum surface.

Further, the numeral 34 is the developing unit which is loaded with black toner, and the black toner image is superimposed on the drum surface in the same processing. A D.C. or further an A.C. bias voltage is applied to sleeves 31A, 32A, 33A, and 34A of developing units 31, 32, 33 and 34. The non-contact development is conducted with the two-component developing agent which is a visualizing medium on the photoreceptor drum 1 the base body of which is grounded.

The color toner image formed on the circumferential surface of the photoreceptor drum 1 in the above-described process, passes under the cleaning unit 60 which is separated from the circumferential surface of the photoreceptor drum 1, while being held on the circumferential surface of the drum. After that, the toner image is uniformly charged again by the charger 20 (FIG. 2 (*b*)), and then pre-transfer exposure (exposure to toner image) by means of the laser exposing unit is conducted on only the portion where the toner image exists according to all the image data which have formed the latent images to that time (FIG. 2 (*c*)). All the image data can be obtained, for example, when image data for each color toner image formation are "OR-ed". In the above-described process, re-charging is not necessarily required after all development has been completed. This is preferable also for improving transfer property, and further, discharging time can be shortened and fatigue of the photoreceptor can be prevented thereby. When re-charging is not conducted, exposure to toner image is not necessarily required to the toner image which has not been re-charged, that is, the toner image which has been formed last because voltage potential is already low. After that, in the transfer section, high voltage having reverse polarity to toner is impressed, and the toner image is transferred onto the transfer sheet which has been conveyed through a paper feed guide 45 from the paper feed cassette 40.

That is, the uppermost sheet of the transfer sheet received in the paper feed cassette 40 is conveyed by the rotation of a paper feed roller 46, and fed to the transfer electrode 41 in timed relation with the image forming section on the photoreceptor drum 1 through a timing roller 47.

The transfer sheet onto which the toner image is transferred, is conveyed to a fixing unit 50, the toner image is fused to be fixed by a fixing roller 50A, and after that, it is delivered on a tray 70.

On the other hand, the photoreceptor drum 1 which has completed transfer onto the transfer sheet, continues to be rotated, and residual toner on the photoreceptor drum is removed by the cleaning unit 60 the blade of which is contacted with the drum surface with pressure. After the completion of the toner removal, the aforementioned blade 60A is separated again from the drum surface and the photoreceptor drum 1 enters the next image forming process.

Figure 2:
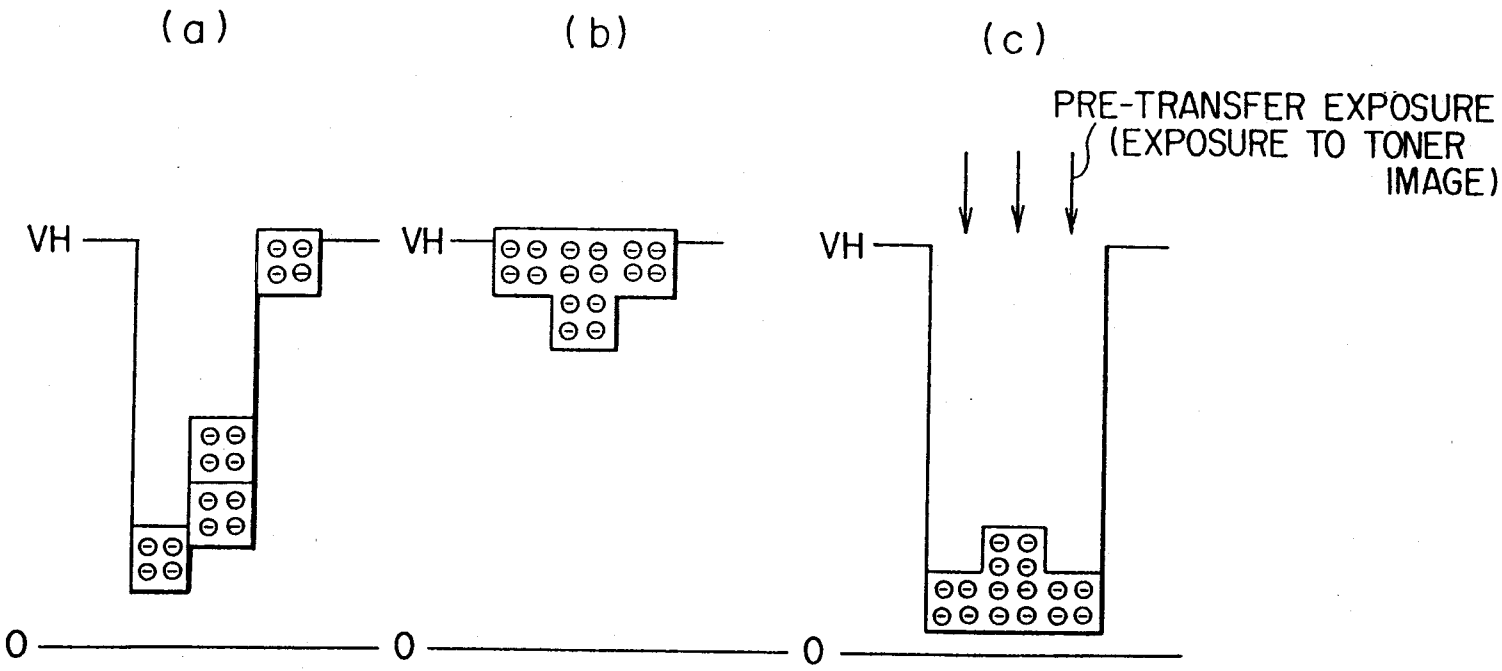
FIG. 2 is a potential distribution drawing showing the surface potential of the photoreceptor after re-charging and exposing of toner portion have been conducted after developing in the image forming method of the present invention.
Figure 3:
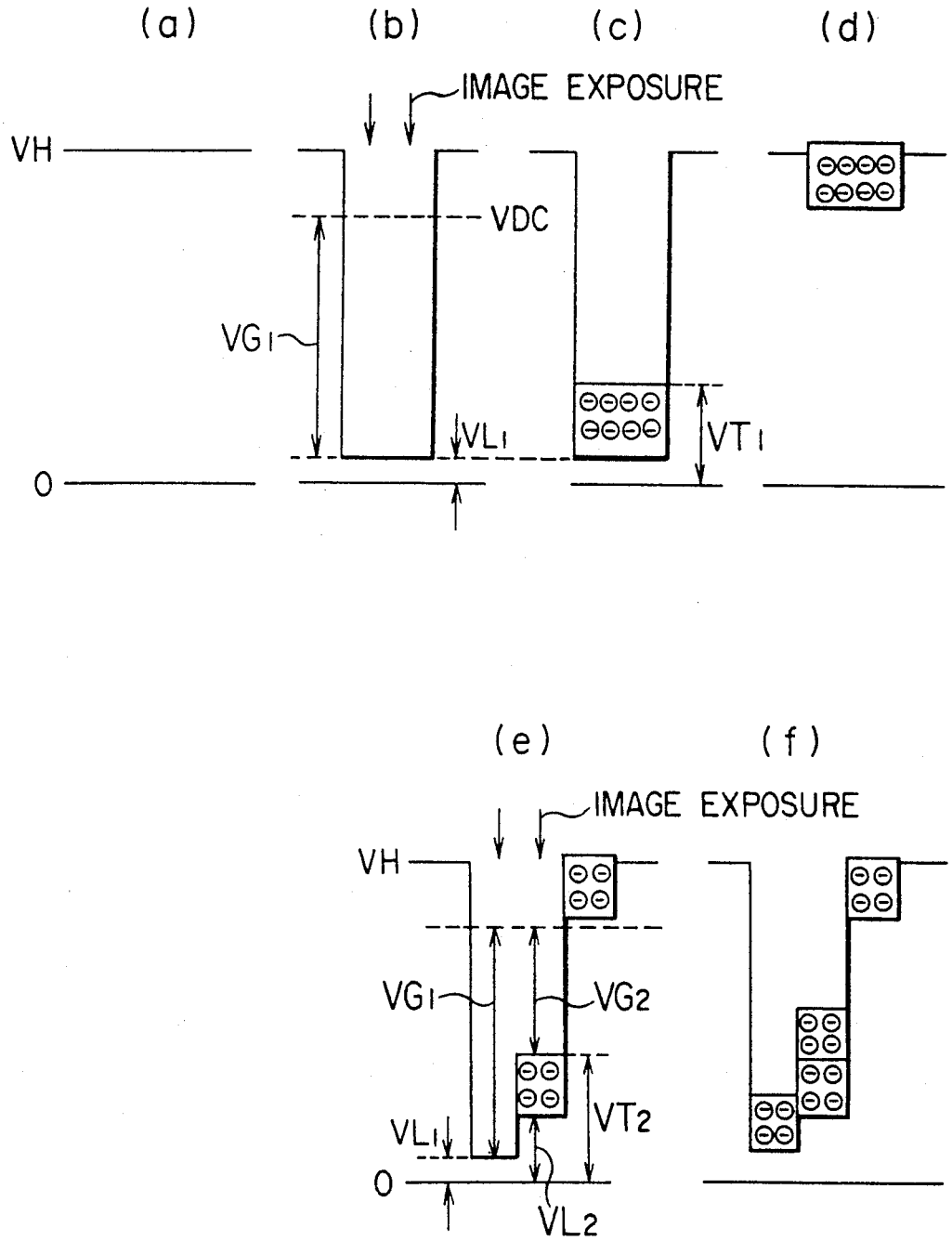
FIG. 3 is a potential distribution drawing showing a toner image forming process in which the toner image is superimposed by conducting repeatedly charging, image exposing and developing on the conventional photoreceptor.
Figure 4:
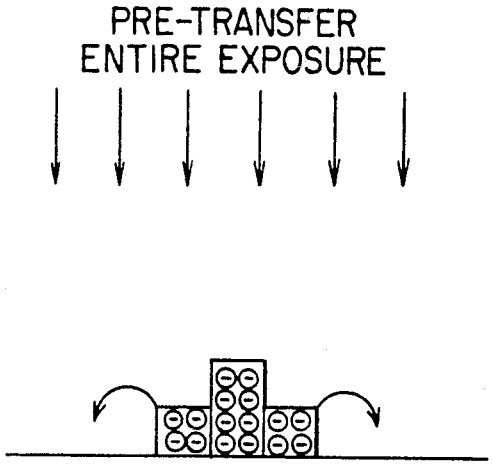
FIG. 4 is a potential distribution drawing at the time when entire exposure is conducted before transfer in the conventional method.

As described above, in the present invention, the exposure to toner image is conducted before transfer, and the photoreceptor surface potential around toner image is held at VH as shown in FIG. 2 (*c*), and therefore toner does not splash at the time of transfer. Further, the transfer efficiency can be improved and the inferior transfer ratio can be lowered. As a result of comparative examinations under high humidity conditions with respect to the case where the exposure to toner image is not conducted and the case where the exposure to toner image is conducted, an extremely excellent image, in which the inferior transfer has not been caused, could be obtained in the case where the exposure to toner image was conducted.

As explained above, in the image forming method of the present invention, exposure is conducted for transfer on only the portion where toner image exists on the image retainer, after all development have been completed. Therefore, highly efficient and uniform transfer is conducted, and an excellent image having no toner splash can be obtained. Accordingly, the present invention can provide excellent advantages in that: a special means is not required for lowering humidity in the apparatus, so that the structure of the apparatus becomes simple; and the transfer material on which special processing is conducted, is not required.

In the aforementioned example, a developing method in which a developing unit using two component developer composed of toner and carrier is used, and developing is conducted by applying developing bias voltage having a D.C component and an A.C component on a developing sleeve, was explained. However, the present invention is not limited to this, but can be applied to a developing method in which the developing unit using one component developer composed of toner is used for development. Further, the present invention can be applied to a developing method in which only a D.C component is applied as developing bias voltage on the developing sleeve.

Further, when the first color toner image is formed, since no toner image exists on the photoreceptor, a contact developing method can be used. Accordingly, it is satisfactory to adopt the above-explained non-contact developing method in the case of toner image formation of two colors or more.

Further, in the above-described example, an example in which one color toner image is formed per one rotation of the photoreceptor drum using one charger 20 and one laser exposing unit 10, was explained. However, it goes without saying that the present invention is not limited to the above-described example, but all toner images can be formed during one rotation of the photoreceptor drum by using a plurality of (a predetermined number of) chargers and laser exposing units. Further, the present invention is not limited to a photoreceptor drum, but can be applied to a belt-shaped photoreceptor.

Further, in the above-described example, a color image forming apparatus as a printer which is separately provided from a reading apparatus, was explained, however, the present invention can be applied to, for example, a color copying apparatus which is integrally structured with a reading apparatus.

What is claimed is:

1. An image forming method comprising the steps of:

(a) charging an image retainer;

(b) imagewise exposing said charged image retainer to image data to form a latent image on said image retainer;

(c) developing said latent image to form a toner image;

(d) sequentially repeating a cycle comprising said charging step, said imagewise exposing step and said developing step, at least once, so as to register a plurality of toner images on said image retainer; then (e) after a last developing step, additionally imagewise exposing only the portions of said image retainer where said registered toner images have been formed on said image retainer in accordance with said image data, from all of said cycles; and then, after the additional imagewise exposing step, (f) transferring said toner images substantially evenly onto a transfer sheet.

2. The method of claim 1, further comprising:

a reversal development step included in said developing step, to form each of said toner images.

3. The method of claim 2, further comprising the additional step of charging said image retainer, after a final sequentially repeating cycle and before said additionally imagewise exposing step.

4. The method of claim 1, further comprising the additional step of charging said image retainer, after a final sequentially repeating cycle and before said additionally imagewise exposing step.

5. An image forming method comprising the steps of:

(a) charging an image retainer;

(b) imagewise exposing said charged image retainer to image data to form a latent image on said image retainer;

(c) developing said latent image to form a toner image so that a toner adheres to an exposed portion of said image retainer;

(d) sequentially repeating a cycle of said charging step, said imagewise exposing step and said developing step, at least once, so that a plurality of toner images are formed on said image retainer; then (e) after a last developing step, additionally imagewise exposing only those portions of said image retainer where said plurality of toner images have been formed on said image retainer in accordance with said image data from all of said cycles; and then, after said additional imagewise exposing step, (f) transferring said plurality of toner images substantially evenly onto a transfer sheet,

6. The method of claim 5, wherein at least said developing step in said sequentially repeating a cycle step comprises a non-contact development step.

7. An image forming method comprising the steps of:

(a) first charging an image retainer to form a charged image region on said image retainer;

(b) first imagewise exposing said charged image retainer to first image data to form a first latent image on said image retainer;

(c) first developing said first latent image to form a first toner image so that a first toner adheres to a first exposed portion of said image retainer to form said first toner image on said image retainer;

(d) second charging said image retainer;

(e) second imagewise exposing said charged image retainer to second image data to form a second latent image;

(f) second developing said second latent image to form a second toner image so that a second toner adheres to a second exposed portion to form said second toner image on said image retainer; then (g) after a last developing step, additionally imagewise exposing only that portion of said image retainer where said first toner image has been formed on said image retainer; and then, after said additionally imagewise exposing step, (h) transferring said first and second toner images substantially evenly onto a transfer sheet.

8. The method of claim 7, wherein at least said additionally imagewise exposing step comprises also exposing said image retainer at that portion of the image retainer where said second toner image has been formed on said image retainer.

9. The method of claim 8, wherein at least said additionally imagewise exposing step comprises exposing said image retainer in accordance with said first and second image data.

10. An image forming method comprising the steps of:

(a) charging an image retainer;

(b) imagewise exposing said charged image retainer to image data to form a latent image on said image retainer;

(c) developing said latent image to form a toner image so that a toner adheres to an exposed portion of said image retainer;

(d) repeating a cycle of said charging step, said imagewise exposing step and said developing step, at least once, to form a plurality of toner images on said image retainer; then (e) after a last developing step, additionally imagewise exposing only the portions of said image retainer where said toner images, except at last formed toner image, have been formed on said image retainer, so that only a plurality of toners, except a last toner, forming said last formed toner image, are additionally imagewise exposed; and then, after the additionally imagewise exposing step, (f) transferring said toner images on said image retainer substantially evenly onto a transfer sheet.

11. The method of claim 10, wherein said additionally imagewise exposing step comprises also exposing said last toner forming said last formed toner image.

12. The method of claim 10, wherein said additionally imagewise exposing step comprises exposing said image retainer to all said image data.

13. The method of claim 10, wherein at least one of said developing steps in said repeating a cycle step comprises a non-contact development step.

14. The method of claim 10, wherein said developing step comprises a non-contact development step.

15. An image forming method comprising the steps of:

(a) charging an image retainer;

(b) imagewise exposing said charged image retainer to image data to form a latent image on said image retainer;

(c) developing said latent image to form a toner image so that a toner adheres to an exposed portion to form said toner image on said image retainer;

(d) repeating a cycle of said charging step, said imagewise exposing step and said developing step, at least once, to form a plurality of toner images on said image retainer; then (e) additionally imagewise exposing only the portions of said image retainer where said toner images, except a last formed toner image, have been formed on said retainer, so that only a plurality of toner except a laster toner that forms said last formed toner image, are additionally imagewise exposed; and then (f) transferring said toner images on said image retainer onto a transfer sheet; and wherein said additionally imagewise exposing step comprises exposing said image retainer to a plurality of image data which is obtained by subtracting a last image data from all other image data.

16. An image forming method comprising the steps of:

(a) first charging an image retainer to form a first charged image region on said image retainer;

(b) first imagewise exposing said first charged image retainer to first image data to form a first latent image on said image retainer;

(c) first developing said first latent image to form a first toner image so that a first toner adheres to a first exposed portion of said image retainer to form said first toner image on said image retainer;

(d) second charging said image retainer to form a second charged image region on said image retainer;

(e) second imagewise exposing said second charged image retainer to second image data to form a second latent image;

(f) second developing said second latent image to form a second toner image so that a second toner adheres to a second exposed portion to form said second toner image on said image retainer; then (g) additionally imagewise exposing only that portion of said image retainer where said first toner image has been formed on said image retainer; then (h) transferring said first and second toner images onto a transfer sheet; and wherein at least said additionally imagewise exposing step comprises also exposing said image retainer to a third image data, said third image data being obtained by subtracting said second image data from said first image data.

* * * * *